US008424350B2

(12) United States Patent
Bernatchez

(10) Patent No.: US 8,424,350 B2
(45) Date of Patent: Apr. 23, 2013

(54) PERSONAL SECURITY KEY HOLDER

(75) Inventor: Georges-André Bernatchez, St-Augustin-de-Desmaures (CA)

(73) Assignee: Projections Yoogo Inc., St-Augustin-de-Desmaures, Quebec (CA)

( * ) Notice: Subject to any disclaimer, the term of this patent is extended or adjusted under 35 U.S.C. 154(b) by 0 days.

(21) Appl. No.: 13/378,492

(22) PCT Filed: Jun. 18, 2010

(86) PCT No.: PCT/IB2010/052774

§ 371 (c)(1), (2), (4) Date: Dec. 15, 2011

(87) PCT Pub. No.: WO2010/146571

PCT Pub. Date: Dec. 23, 2010

(65) Prior Publication Data

US 2012/0090528 A1 Apr. 19, 2012

Related U.S. Application Data

(60) Provisional application No. 61/218,544, filed on Jun. 19, 2009.

(51) Int. Cl.
*A44B 15/00* (2006.01)

(52) U.S. Cl.
USPC ..... 70/456 R; 70/459; D3/211; D3/212

(58) Field of Classification Search ..... 70/456 R, 70/459; D3/207–212
See application file for complete search history.

(56) References Cited

U.S. PATENT DOCUMENTS

| | | | |
|---|---|---|---|
| 4,160,369 | A | 7/1979 | Pearson |
| 4,498,669 | A | 2/1985 | Chun |
| 4,739,990 | A | 4/1988 | Aguirre et al. |
| D301,513 | S | 6/1989 | Wright |
| D308,297 | S | 6/1990 | Romano |
| 5,108,098 | A | 4/1992 | Ashihara |
| D333,692 | S | 3/1993 | Parsons |

(Continued)

FOREIGN PATENT DOCUMENTS

| | | |
|---|---|---|
| CA | 2052972 | 5/1992 |
| WO | 9111054 | 7/1991 |
| WO | 2008045003 | 4/2008 |

*Primary Examiner* — Suzanne Barrett
(74) *Attorney, Agent, or Firm* — Fasken Martineau

(57) ABSTRACT

A key holder for personal security including a L-shaped body having a main elongated portion and a secondary elongated portion joined to the main elongated portion at a junction end of the main elongated portion, the secondary elongated portion being one of equal and shorter than the main elongated portion; an enlarged head at a head end of the secondary elongated portion, the enlarged head being larger than a width of the secondary elongated portion, the head end being opposed to the junction end; a key attachment provided on an outside of the junction end, the key attachment adapted to attach keys to the key holder, the secondary elongated portion being adapted to be received between two fingers of a single hand of a user, the main elongated portion being adapted to be received in a palm of the single hand. Additionally, a whistle can be provided at a whistle end of the main elongated portion, the whistle end being opposed to the junction end. Additionally, a light can be provided on the enlarged head.

10 Claims, 15 Drawing Sheets

U.S. PATENT DOCUMENTS 5,192,074 A 3/1993 Ashihara
D352,339 S 11/1994 McGowan
5,405,134 A 4/1995 Wolfram
5,475,368 A 12/1995 Collins
5,712,619 A 1/1998 Simkin
5,737,951 A * 4/1998 Krass ..... 70/456 R
5,783,875 A 7/1998 Jaros
D398,365 S 9/1998 Bader
5,829,643 A * 11/1998 Isabella ..... 222/175
5,863,251 A 1/1999 Fusco
D408,627 S * 4/1999 Chiu ..... D3/211
5,956,985 A * 9/1999 Chang ..... 70/456 R
6,016,676 A * 1/2000 McConnell ..... 70/408
6,141,999 A * 11/2000 Whittaker et al. ..... 70/456 R
6,147,611 A 11/2000 Otero
6,216,501 B1 * 4/2001 Marquardt et al. ..... 70/252
6,578,397 B1 * 6/2003 Altrich et al. ..... 70/408
6,591,646 B1 * 7/2003 Huang ..... 70/456 R
6,626,019 B1 * 9/2003 Huang ..... 70/456 R
6,811,493 B1 11/2004 Lee
D503,451 S * 3/2005 Tal ..... D22/117
D504,222 S 4/2005 Kieffer
D505,784 S * 6/2005 Yeh ..... D3/211
D509,353 S 9/2005 Billings
6,942,362 B1 9/2005 Deutsch
7,156,535 B1 1/2007 Deutsch
7,185,999 B2 3/2007 Lui
7,503,829 B2 * 3/2009 Cory, Jr. ..... 446/473
D641,151 S * 7/2011 Bernatchez ..... D3/212
D641,152 S * 7/2011 Bernatchez ..... D3/212
D649,343 S * 11/2011 Bernatchez ..... D3/212
D649,344 S * 11/2011 Bernatchez ..... D3/212
2002/0017231 A1 2/2002 Tanaka
2004/0155781 A1 8/2004 DeOme
2005/0237736 A1 10/2005 Wimsatt
2007/0133201 A1 6/2007 Lui
2007/0238532 A1 10/2007 Stethem
2008/0178251 A1 7/2008 Shin

* cited by examiner

PERSONAL SECURITY KEY HOLDER

CROSS-REFERENCE TO RELATED APPLICATIONS

The invention is a national phase entry under 35 U.S.C. §371 from PCT Application No. PCT/IB2010/052774, entitled "PERSONAL SECURITY KEY HOLDER", filed on 18 Jun. 2010; which in turn claims priority of US provisional patent application No. 61/218,544 filed on Jun. 19, 2009 by Applicant, the specifications of which are hereby incorporated by reference.

BACKGROUND OF THE INVENTION

1. Technical Field

The invention relates generally to a key holder, more specifically to key holders having practical and personal security features.

2. Description of the Related Art

Key holders typically have a sole purpose, namely grouping keys together and securing them together to prevent loss of individual keys. A decorative element is often provided on a key ring to which the keys are attached.

Self-defense and personal security instruments, such as nightsticks, flashlights, pepper sprays canisters, whistles, etc are typically very efficient for self-defense purposes and useful to trained individuals but quite cumbersome and not easily manipulated by average adults in a self-defense situation.

There is therefore a need for a key holder which provides both practical day-to-day manipulation of keys and personal security capability.

SUMMARY

One aspect of the invention provides a key holder for personal security including a L-shaped body having a main elongated portion and a secondary elongated portion joined to the main elongated portion at a junction end of the main elongated portion, the secondary elongated portion being one of equal and shorter than the main elongated portion; an enlarged head at a head end of the secondary elongated portion, the enlarged head being larger than a width of the secondary elongated portion, the head end being opposed to the junction end; a key attachment provided on an outside of the junction end, the key attachment adapted to attach keys to the key holder, the secondary elongated portion being adapted to be received between two fingers of a single hand of a user, the main elongated portion being adapted to be received in a palm of the single hand.

Additionally, in one embodiment, a whistle can be provided at a whistle end of the main elongated portion, the whistle end being opposed to the junction end.

Additionally, in one embodiment, a second enlarged head can be provided at a free end of the main elongated portion, the free end being opposed to the junction end.

In one embodiment, the main elongated portion and the secondary elongated portion are joined at a right angle.

In one embodiment, the main elongated portion and the secondary elongated portion are joined at an angle of 90°±20°.

In one embodiment, the secondary elongated portion has a recessed neck portion, the recessed neck portion having a width smaller than a width of the secondary elongated portion near the junction end.

In one embodiment, one of the main elongated portion and the secondary elongated portion is at least partly hollow and adapted to receive a power unit.

Additionally, a light can be provided on the enlarged head and powered by said power unit for illuminating a field of view.

In one embodiment, a switch on at least one of the main elongated body and secondary elongated body for controlling said power unit for turning on the light.

In one embodiment, the main elongated portion has a length one of equal and smaller than a width of a hand of a user.

In one embodiment, the secondary elongated portion has a length one of equal and longer than a thickness of a finger of a user.

BRIEF DESCRIPTION OF THE DRAWINGS

Having thus generally described the nature of the invention, reference will now be made to the accompanying drawings, showing by way of illustration a preferred embodiment thereof and in which.

It will be noted that throughout the appended drawings, like features are identified by like reference numerals.

DETAILED DESCRIPTION

With reference to the drawings, FIGS. 1 to 8 show an example of a personal security key holder 100 which comprises a main elongated portion (body) 102 with, at one of its extremities, a secondary elongated portion (neck) 104, at a substantially right angle to the body 102. The key holder 100 is therefore L-shaped. Preferably, the body 102 has a length smaller than or equal to the width of a hand of a user. It is typically cylindrical in shape, with a regular or irregular cross-section which can be ellipsoidal, square, rectangular, etc. The neck 104 is shorter than the body 102 and is typically also cylindrical with a regular or irregular cross-section which can be ellipsoidal, square, rectangular, etc.

Figure 5:
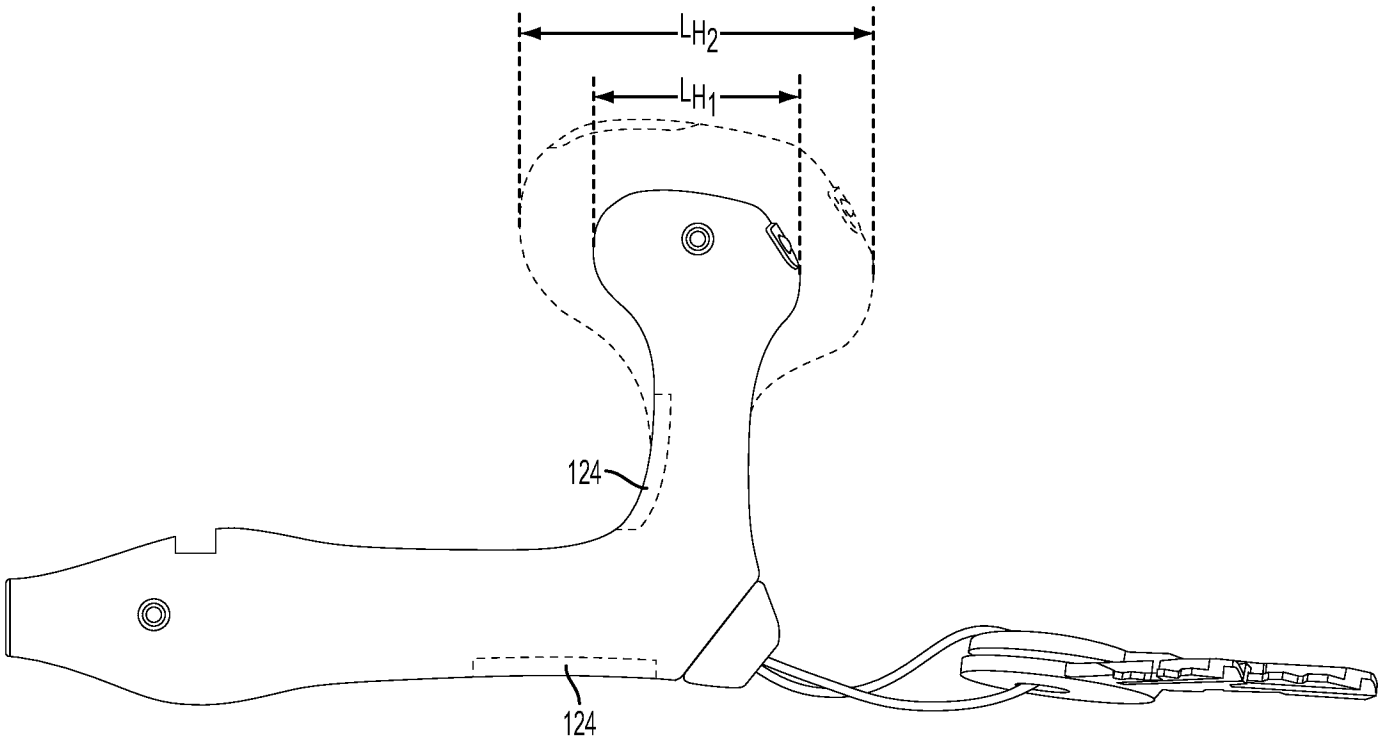
FIG. 5 is a right side view of the example key holder of FIG. 1 with an alternative head shown and switch plates shown in dashed lines.
Figure 6:
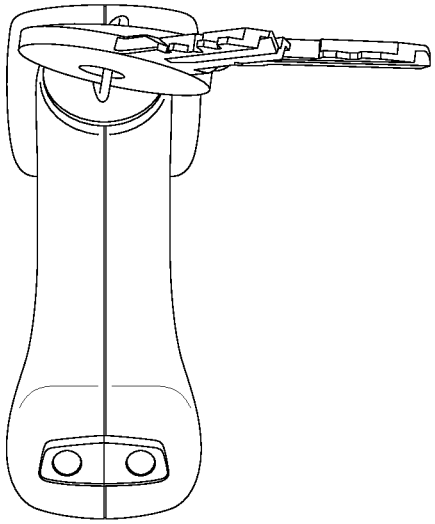
FIG. 6 is a front view of the example key holder of FIG. 1.
Figure 7:
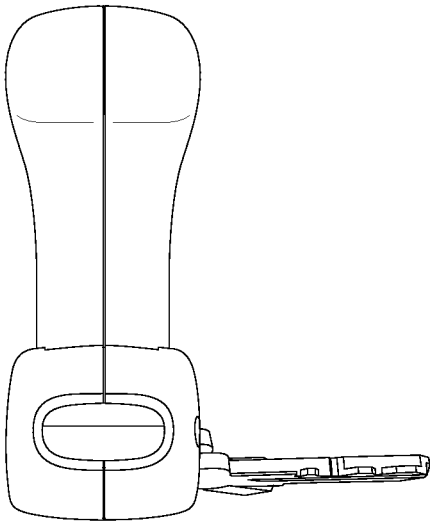
FIG. 7 is a rear view of the example key holder of FIG. 1.

At the extremity of the neck 104 which is not attached to the body 102, the neck 104 ends in a bulbous, spherical, orthogonal, rectangular, ovoid, ellipsoidal or figurative shaped enlarged head 108. The neck 104 has a recessed portion 110 between the junction 112 with the body 102 and the head 108. The recessed neck 110 is of a size for comfort to the user. The length of the neck 104 without the head 108 corresponds to the length of the recessed portion 110 and is about the same length as the thickness of fingers of a user. The head can be centered or offset with respect to the neck 104. The head can have a figurative shape to represent a character or an animal. The enlarged head 108 should not end in a sharp edge or be pointy. It can have a fairly flat rounded top. An alternately sized head is shown in FIG. 5 in dashed lines.

At the junction 112 of the body 102 and the neck 104, exterior to the L, there is provided a key ring, a key string or other key attachment means. This attachment to the junction 112 allows complete rotation of the keys 116 with respect to the key holder 100. The key attachment may be provided anywhere on the outside surface of the junction of the L-shaped key holder. The key attachment means can itself rotate and/or can allow the keys to pivot. Keys 116 can be any type of keys, including car keys, house keys, handcuff keys, etc. The key attachment means can have different shapes, textures, rigidities, etc.

If a key ring (not shown) is used for the key attachment means, the key ring can be attached to a protuberance extending outside of the junction of the L-shaped key holder. This protuberance can be integral with the body of the key holder or provided on a removable joint which is screwed, attached or otherwise made to adhere to the junction of the key holder. The key ring can also be attached directly to the junction of the key holder and provided with an opening for the insertion/removal of keys.

Figure 10:
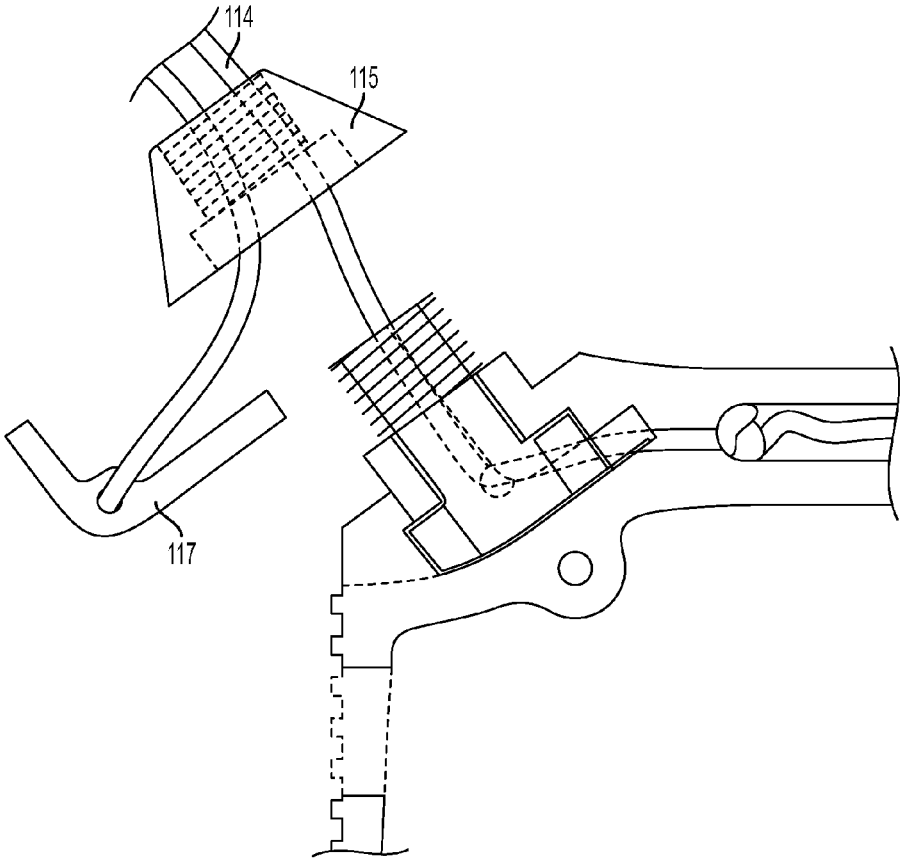
FIG. 10 is an exploded view of the interior configuration of an example key attachment means.
Figure 11:
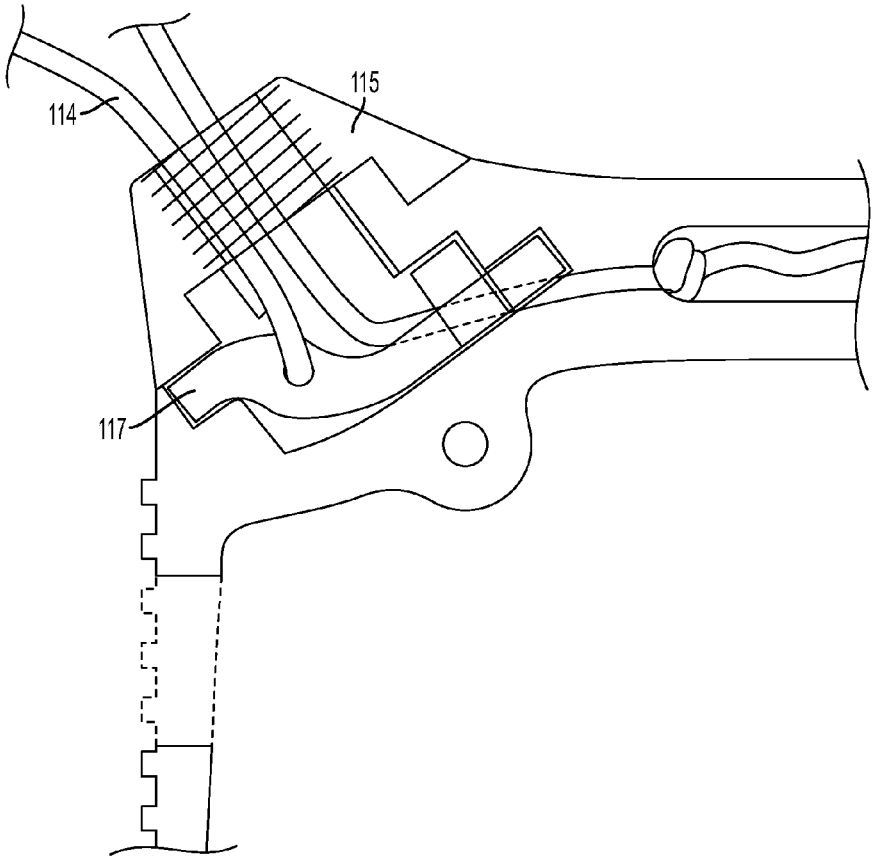
FIG. 11 is an assembled view of the interior configuration of an alternate key attachment means.

Instead of using a key ring, the key holder can be provided with a key string 114 which is secured to the key holder. The string can be retractable, stretchable, etc. In the example shown in FIG. 10, the neck 104 and/or the body 102 is hollow and is adapted to receive and hold one end of a key string 114. The key string 114 is then threaded through a cap 115 and a retainer 117. The string need not be detached from the retainer to allow insertion/removal of keys. The retainer can simply be inserted through the key hole. In an alternative embodiment, a key ring can be placed on the string by inserting the Allen key through the key ring and the key(s) can be attached to the key ring in the usual manner. Once all keys 116 are provided on the string 114, the string 114 is attached to the retainer 117 and the retainer is inserted into the hollowed portion of the junction 112. The cap 115 is screwed, snapped, attached or otherwise made to adhere to the junction of the key holder to secure the key attachment means. Different shapes of retainers, caps, hollowed sections of the junction and strings can be used without departing from the invention, such as the alternate version of FIG. 11.

The retainer 117 can be shaped as a small hex key or Allen key which is then readily available for other purposes such as for opening of the casing of the key holder if an appropriate closure is provided on the casing to retain the pieces together.

As will be readily understood by one skilled in the art, different sizes of key holders are possible, keeping in mind the basic characteristics for the key holder, namely the L-shaped key holder, the enlarged head and the key attachment means on the outside junction of the L.

The body, neck and head can be provided in an integral piece of material or assembled to form an L-shaped body using multiples pieces of material. It can be manufactured by molding, by machining, etc.

The surface of any component of the key holder 100 can be textured for a better grip, for discomfort to the attacker once pressed onto the attacker's body, for comfort to the user in use, or for any other reason. All components of the key holder 100 can have any type of hardness required for their purpose. The surfaces can have different finish or textures such as sleek, serrated, spiked, soft, hard, etc. The head 108 and the end of the body 102 can be made of a hard material such as steel, hard plastic, etc. of a durable nature. The material can be opaque or translucent.

The key holder could be provided with accessories such as a protective sleeve covering at least a portion of the key holder. The protective sleeve could include patterns and materials to personalize the key holder. For example, the key holder head and neck portions could be covered with clothes and hair to create a character.

In the example shown in the drawings, at the extremity of the body 102 which is not attached to the neck 104, the body ends in a whistle 106. The whistle 106 in the example shown has an elongated shape so that it forms part of the elongated shape of the elongated body 102. As will be understood, the whistle can take on many different shapes. However, comfort of the user should be taken into account since the body 102 is to be held within the palm of one hand of a user. The whistle can be made integral with the body 102 or provided as an insert within the hollow body 102. The whistle can be a single chamber whistle, a double chamber whistle, a whistle with a plurality of chambers or an electronic whistle. If any space is available under, over or besides the whistle chamber, it can be used to store components needed for some of the features of the key holder.

Figure 12:
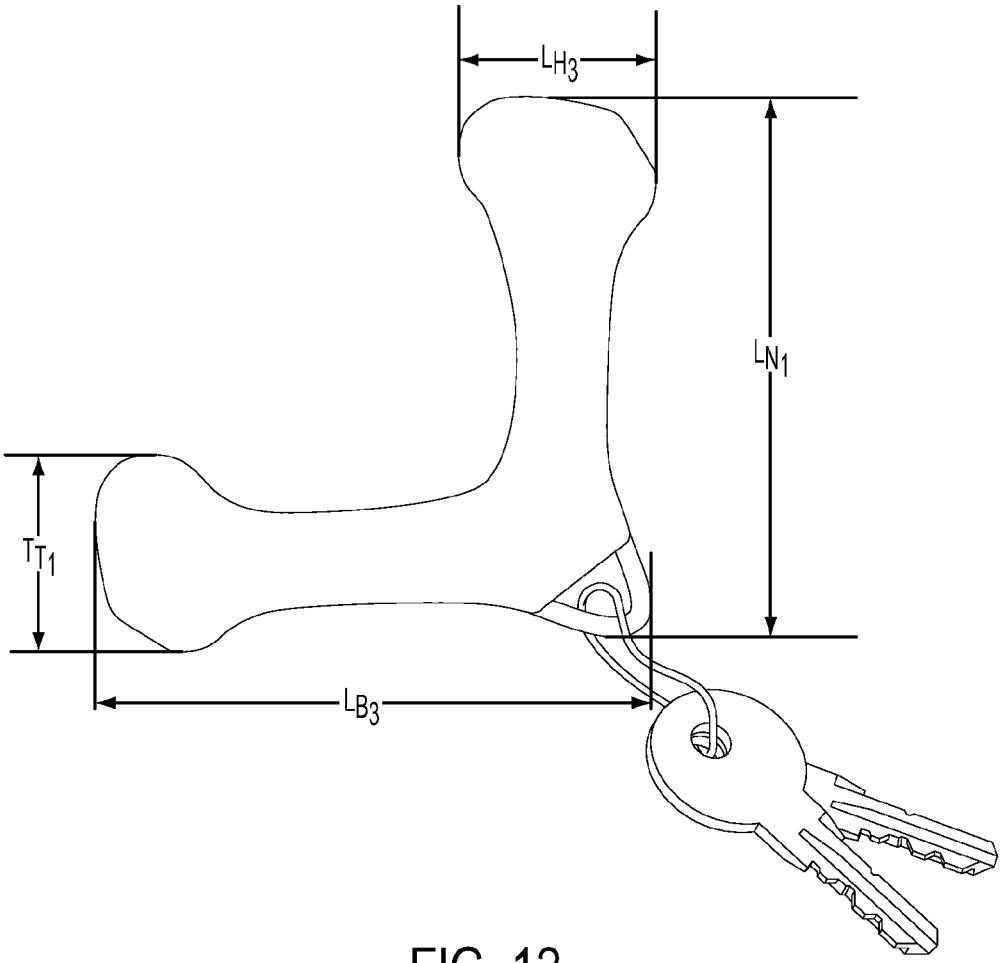
FIG. 12 is a side view of an alternate key holder.

As will be readily understood, the whistle is optional and if omitted, the key holder still bears the personal security features. In the embodiment where the whistle is omitted, such as in FIG. 12, a second enlarged head can be provided at the free end of the body 102 which is not joined to the neck 104. This second enlarged head can take on a similar or different shape from the head 108 and can be made of a similar or different material. In this alternate embodiment, the length of the neck including the head $L_{N1}$ is equal to the length of the body $L_{B3}$. The second head is symmetrical to the head and the thickness of the second head $T_{T1}$ is equal to the length of the head $L_{H3}$. The key attachment means is also very simple, consisting of a simple ring to which the key are attached via a string.

It should be noted that to respect the general configuration of the key holder which is L-shaped, the outside surface of the junction 112 should not extend much further out of the key holder than the width of the head 108 and should not extend much further out of the key holder than the thickness of the whistle 106 or second enlarged head. It will be readily understood that the L-shaped configuration does not require strict interpretation and that the elongated portions can be curved, tapered and/or irregular in shape and can still meet at the junction. The angle of the junction has a broad definition such as 90 degrees±40 degrees.

The head 108 can be provided with at least one light 118, for example a LED which is oriented so that the key attachment means (and therefore the keys 116) is illuminated when the light 118 is turned on. The body 102 with the whistle 106 need not be illuminated when the LED is turned on. For example, the light 118 can have a 270° field of view in all directions. The light 118 can generate a light of any color. A configuration with two LED's is shown in the drawings. In a policeman example embodiment, the light 118 could comprise two LED, one red LED and one blue LED, adapted to alternate to generate an illumination pattern similar to that of lights on police cars. Because the light illuminates away from the whistle end of the body and towards the keys, the face of the user is not illuminated if the user is using the whistle, adding a personal security feature. Also, because the keys are illuminated, it is easier for the user to find the adequate key and use it if the surroundings are dark.

As shown in FIG. 5, an on/off switch 124 for the light 118 can be located anywhere on the body 102 or on the neck 104. It can be a push switch or a switch activated by the displacement of a portion of the key holder 100. The switch 124 can include two touch pads located on different sections of the key holder which need to be touched at the same time to trigger illumination. Each plate or touch pad can have a length of between 2 to 15 mm, typically of at least 10 mm and be adapted to be touched by the skin of the user while avoiding contact with keys or by objects in a pocket or purse.

The illumination can be patterned, in order to attract attention, for example using a blinking pattern. Additionally, the illumination can include a stroboscopic effect to blind an attacker. The illumination pattern can be automatically turned on by the switch 124 or a combination of switch manipulations can trigger it, such as, for example, a long (3 seconds) pressure on the push button switch. Alternatively and additionally, the illumination pattern can be triggered by the use of the whistle 106.

The light 118 could also be activated by movement of the key holder, a specific sequence of movement being detectable by a motion activated detector provided within the key holder. The light 118 could also include a position detector to detect the position of the head with respect to the body. Depending on the angle at which the key holder is held by the user (while the light is turned on by appropriate switches), the light 118 could be triggered to illuminate in a normal pattern, for example a steady illumination or in an emergency pattern, for example a stroboscopic illumination.

Figure 8:
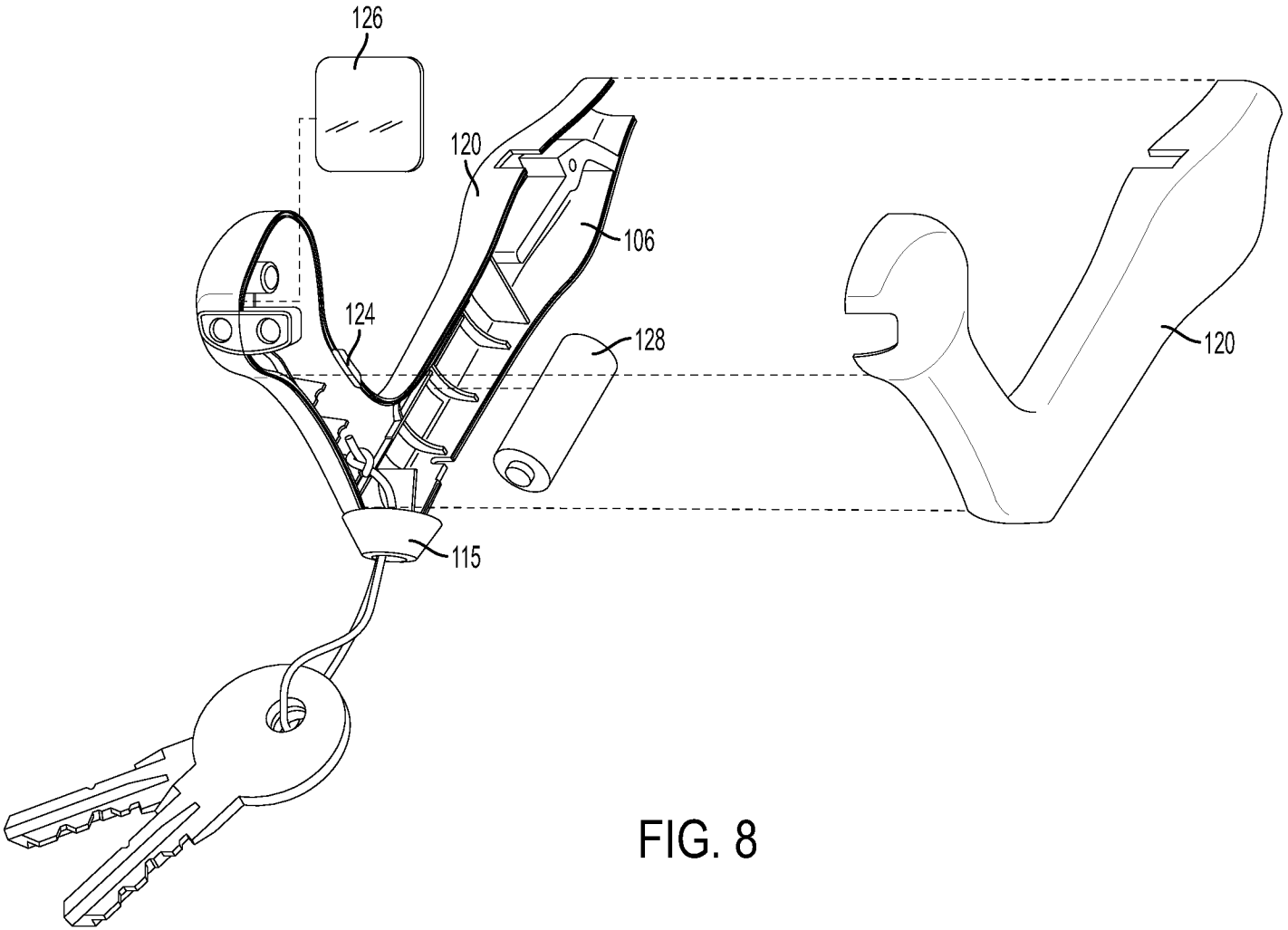
FIG. 8 is an exploded view of the example key holder of FIG. 1.

The body 102 can made of two pieces which can be released (for example, the two pieces are threaded, sapped, etc.) to gain access to the interior of the body 102. The separation of the pieces 120 can be longitudinal, transversal or any other way. The interior of the body 102 contains a power unit, typically one or many commercially available batteries 128, to provide power to the light 118 and the other electronic components of the key holder. The whistle end 106 of the body can therefore be fully or partly provided on one of the two pieces 120 and can therefore be cleaned, replaced, etc. As shown in FIG. 8, the key holder 100 can be separated into two halves along the length of the body and the neck.

Figure 9:
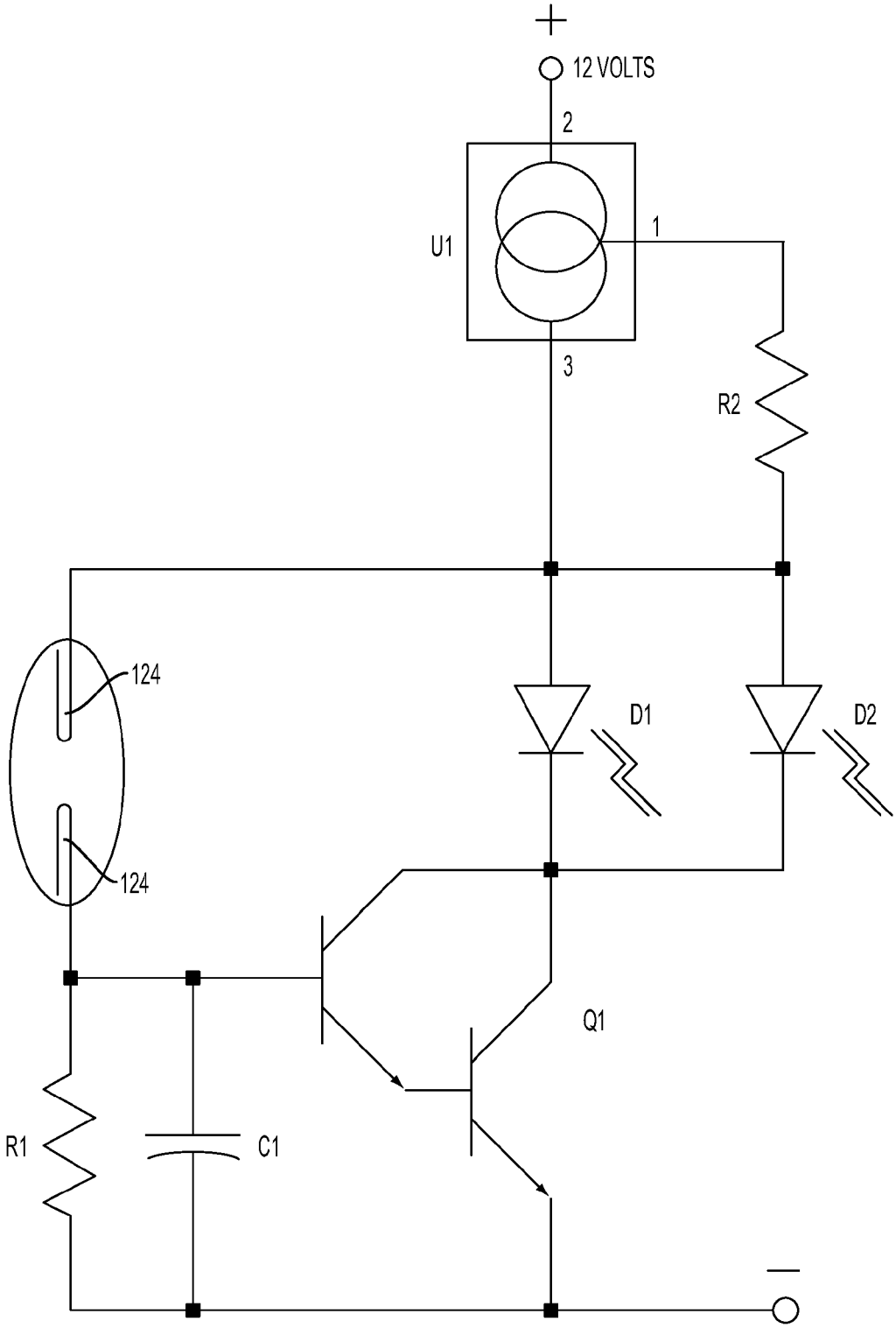
FIG. 9 is a schematic showing an example electronic circuitry that can be used with the example key holder of FIG. 1.

An electronic circuitry can be used to control the light. An example of such an electronic circuitry 126 is found in FIG. 9. In this example circuit, a 12V 23A-type battery provides the power supply for the circuit. Two Kingbright white 3 mm LEDs D1 and D2 are used. A SMT capacitor C1 manufactured by TDK in the FHV series having specs of 1200 picofarads and 12 volts is used. A Darlington transistor Q1 with a minimal HFE of 15,000× with a minimum collector current of 100 mA is used. A SMT resistor R1 of 1 megohm at 0.0625 watt manufactured by Vishay in the CRA series is used. A SMT resistor R2 of 6 ohms at 100 miliwatt manufactured by Vishay is used. A SOT three-terminal adjustable current source U1 number LM334 is also used. The whole circuit runs on 12V. The two plates 124 form the two-part switch. The two plates 124 need to be touched by the user at the same time to allow the circuit to be powered on and thereby activate the LEDs. A separate hardware switch is not provided in this example circuit but could be added to prevent involuntary turning on of the LEDs. Some components of the electronic circuitry can be provided on a printed circuit board. It could include a micro-controller. This board can be made of a flexible material and inserted within the head, neck or body of the key holder 100. Adequate wiring should be provided if needed.

Figure 1:
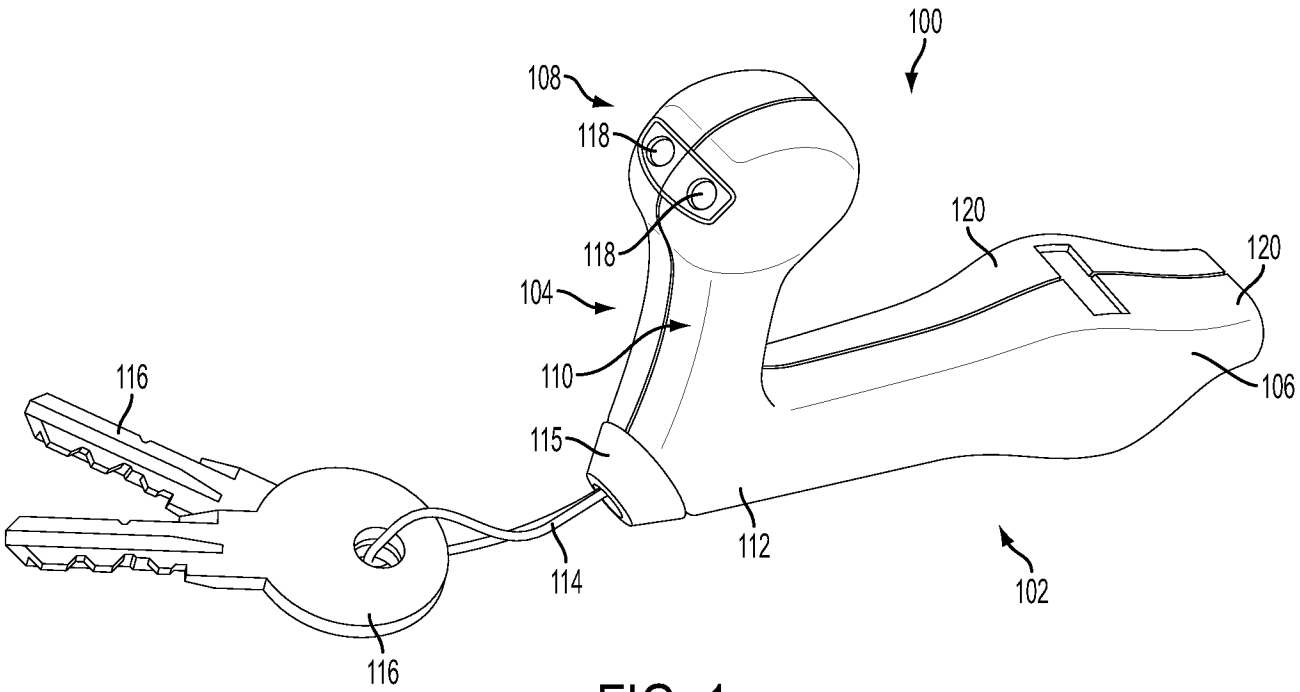
FIG. 1 is a perspective view of an example key holder.
Figure 2:
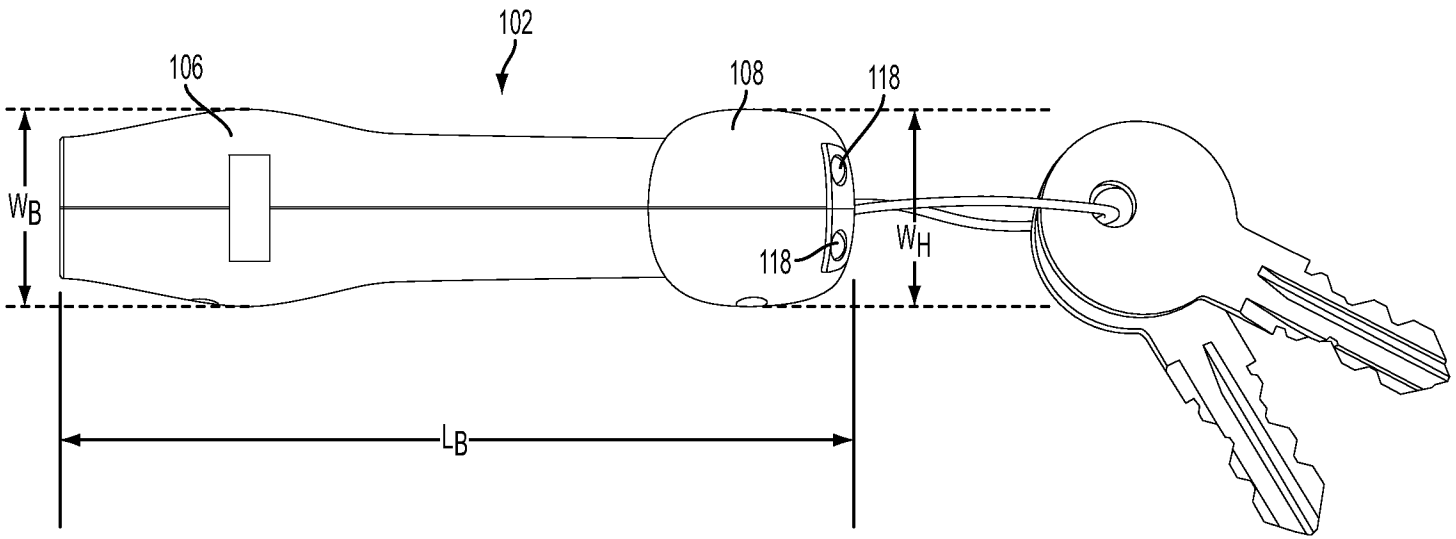
FIG. 2 is a top view of the example key holder of FIG. 1.
Figure 3:
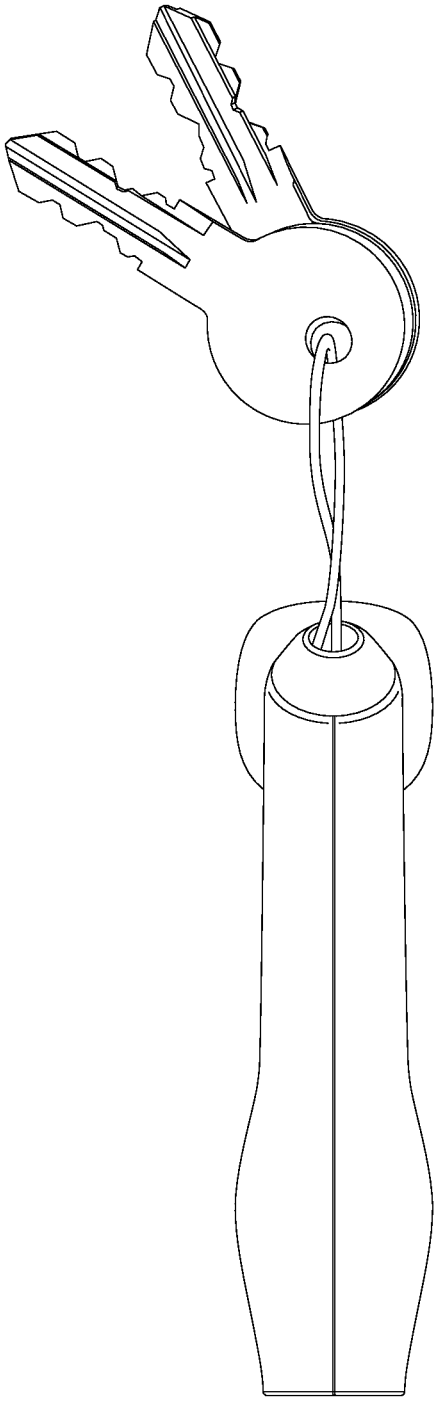
FIG. 3 is a bottom view of the example key holder of FIG. 1.
Figure 4:
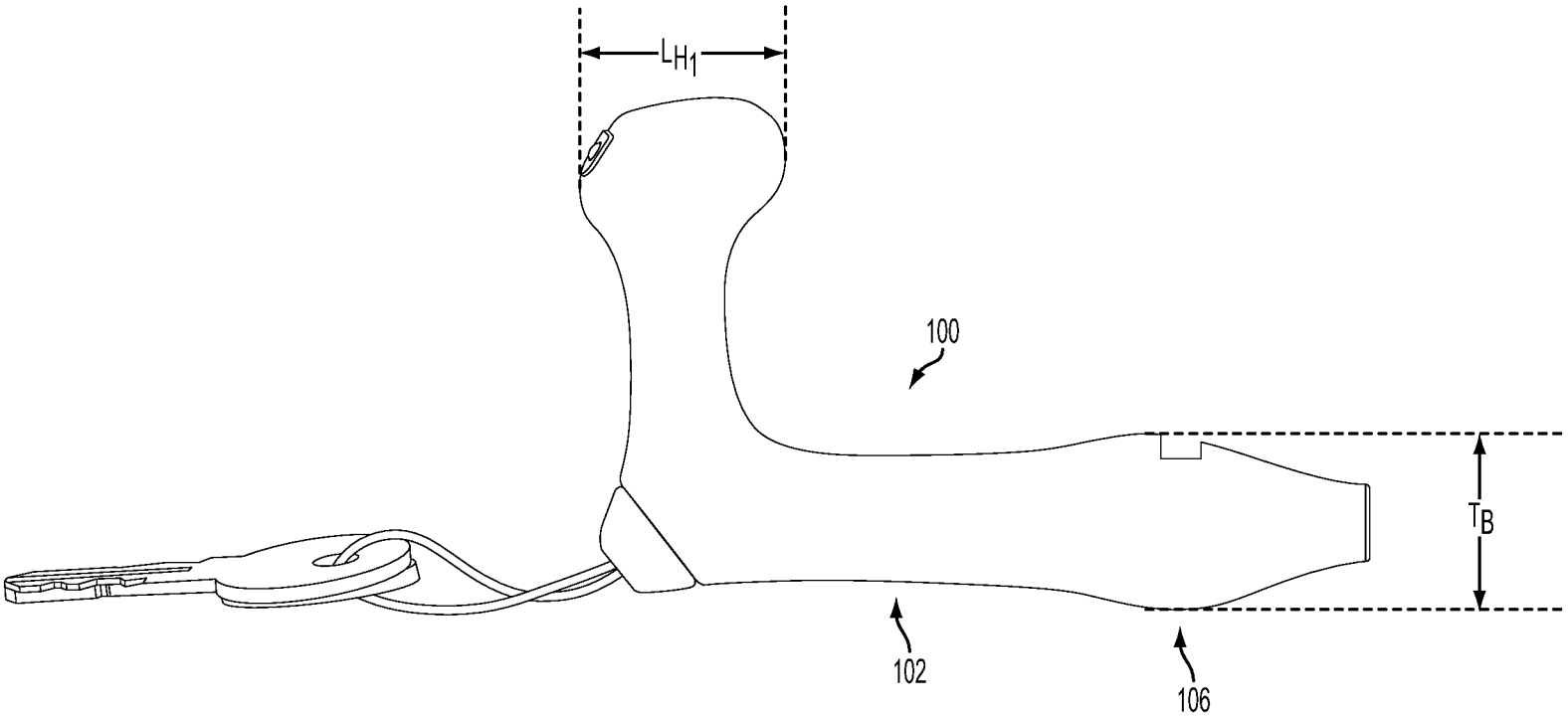
FIG. 4 is a left side view of the example key holder of FIG. 1.

The dimensions of the example personal security key holder 100 of FIG. 1 are a body thickness $T_B$ for the body 102 of 0.5 to 4 cm (this can be the body diameter if the body 102 is cylindrical), a length of the body 102 $L_B$ of 3 to 15 cm, a length of the head 108 from 1 cm ($L_{H1}$) to 4 cm ($L_{H2}$), a width of the body $W_B$ and the width of the head $W_H$ being 1 to 4 cm and the length of the neck excluding the head of 1 to 5 cm.

Examples of use of the key holder will now be detailed using FIGS. 13-16 which show the key holder in use.

Figure 13:
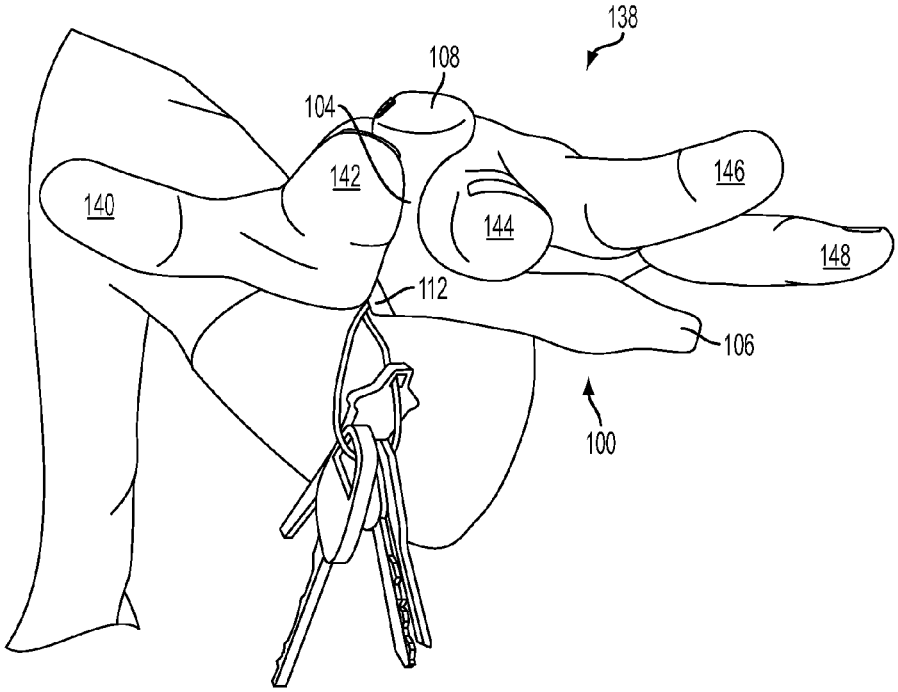
FIG. 13 depicts the key holder of FIG. 1 in use as a key holding device just after insertion between fingers of a user's hand.

In use as a key holding device, the neck 104 of the key holder 100 is inserted between two fingers of the user, pushed until the recessed portion 110 rests at the junction between the two fingers. The head 108 sticks out of the dorsal side of the hand 138. The junction 112 is inside the hand 138 next to the thumb 140, the body 102 being placed within the inside of the hand of the user, the keys 116 sticking out next to the thumb 140. The whistle end 106 is next to the little finger 148. FIG. 13 depicts the key holder of FIG. 1 in use as a key holding device just after insertion between fingers of a user's hand. The two fingers used to grab the key holder are any two fingers of the user. Typically, the user will be more comfortable if the neck is inserted between the index 142 and the middle finger 144.

Figure 14:
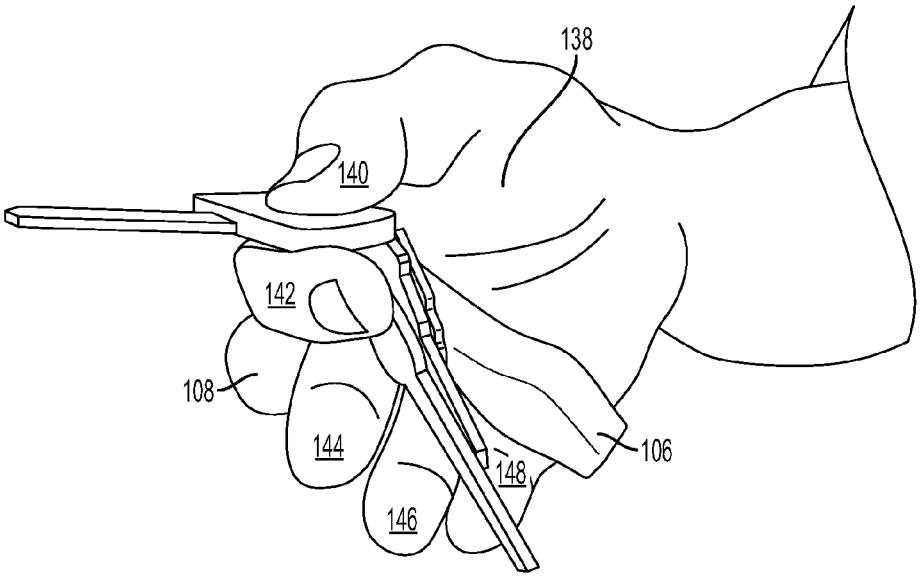
FIG. 14 depicts the key holder of FIG. 1 in use as a key holding device after insertion and while the user is handling a key.

Once the key holder is inserted in the hand of the user, it is easy for the user to find the right key 116 while his open palm faces him with the keys inside the palm, turn on the light 118 using the switch 124 if necessary. FIG. 14 depicts the key holder of FIG. 1 in use as a key holding device after insertion and while the user is handling a key.

Figure 15:
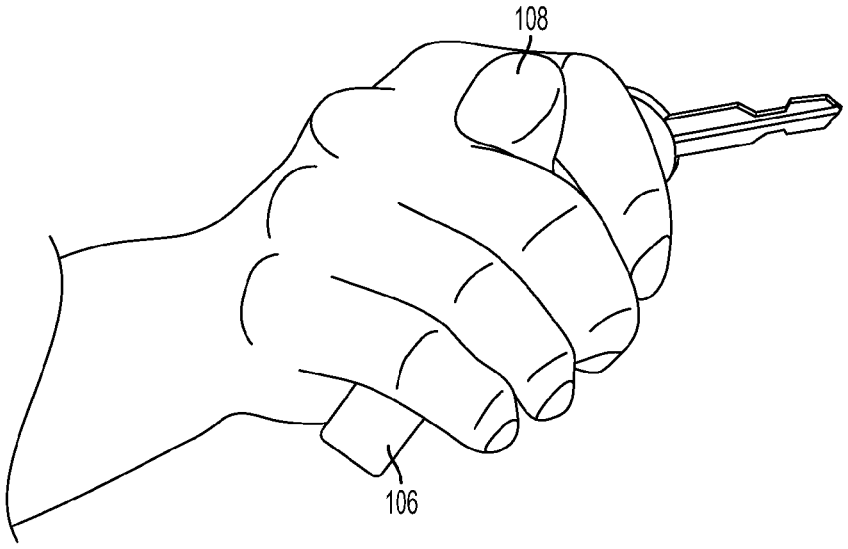
FIG. 15 depicts the key holder of FIG. 1 in use as a key holding device where the wrist of the user is rotated to use the handled key to unlock a lock.

If the fingers are closed in a loose fist around the key holder with the appropriate key sticking out between the index finger and the thumb, a lock is easily opened with the key 116. FIG. 15 depicts the key holder of FIG. 1 in use as a key holding device where the wrist of the user is rotated to use the handled key to unlock a lock.

Because the key holder 100 is locked between the fingers with the recess 110 and because the combination of the head 108 and the body 102 ensures that the key holder 100 stays in the outstretched hand, the user can even pick up other things while continuing to hold on to the keys 116, all fingers being free to grab something else.

Figure 16:
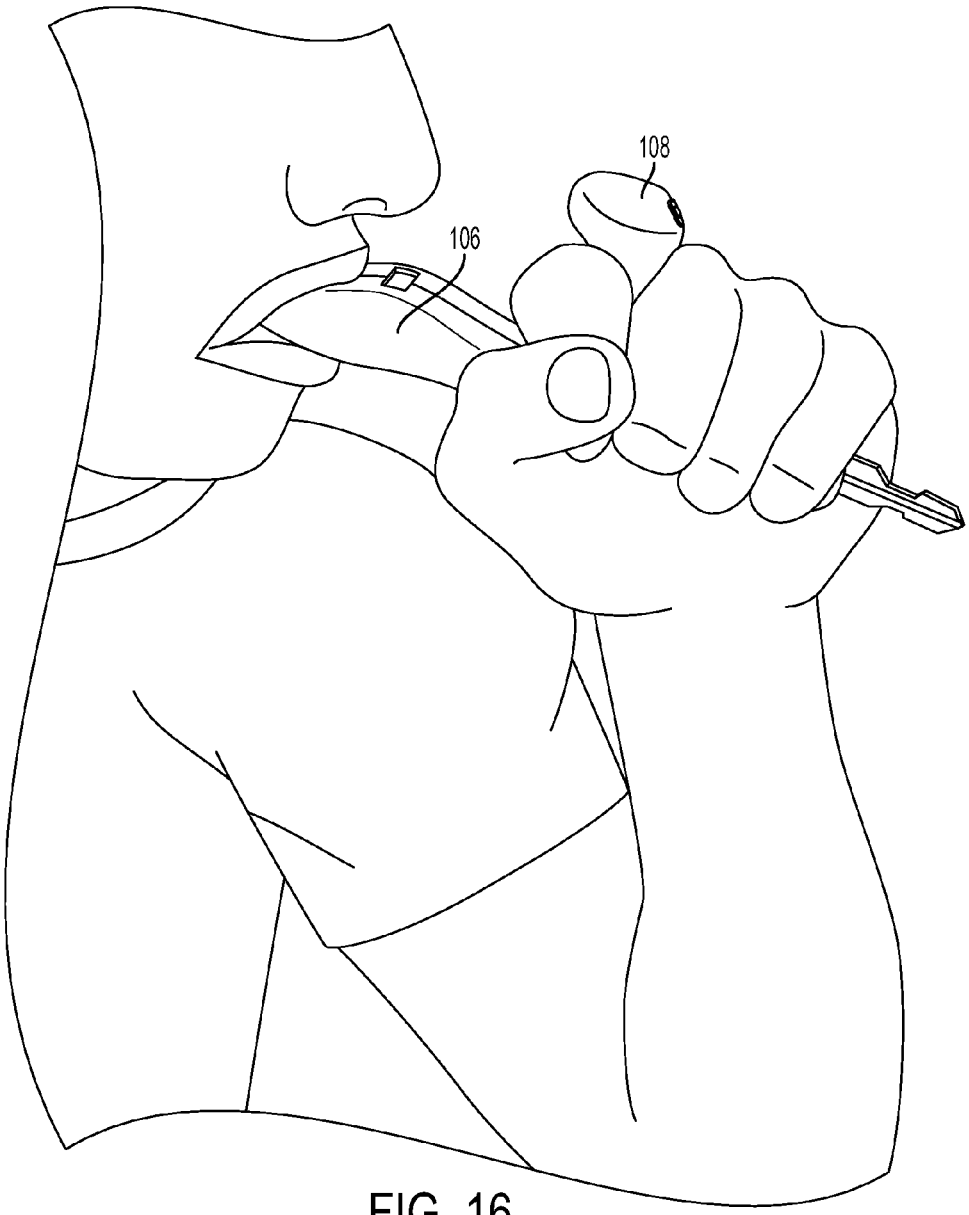
FIG. 16 depicts the key holder of FIG. 1 in use as a personal security device where the whistle end of the key holder was rotated within the hand of the user to exit the palm near the thumb while keeping the key holder inserted between the same fingers of the user's hand.

As shown in FIG. 16, in use in an emergency situation, the body 102 is rotated using the thumb and the fingers to displace the junction 112 and the keys 116 next to the little finger and to bring the whistle end 106 next to the thumb, while maintaining the neck 104 between the same two fingers with the head 108 sticking out. The key holder does not need to be removed and replaced in the hand, but rather only needs to be rotated while being held by the neck. The whistle 106 can then be used by the user, the light 118 can be turned on, etc. In this situation, the keys 116 are sticking out of the hand next to the little finger. They can be shown to the attacker and potentially used as a personal security tool. The head 108 and the end of the body 102 with the whistle 106 are made of a hard material and can also be used as a personal security tool. FIG. 16 depicts the key holder of FIG. 1 in use as a personal security device where the whistle end of the key holder was rotated within the hand of the user to exit the palm near the thumb while keeping the key holder inserted between the same fingers of the user's hand.

As can be understood, the enlarged head can take on many different shapes, but should remain wider than the recessed portion 110. It then creates a handle by blocking displacement of the key holder in all directions: between two fingers on either side of the recessed portion 110, outside of the hand by the enlarged head 108 and inside the palm of the hand by the body 102.

The following additional features of the key holder 100 are not shown in the drawings and are simply listed as examples of components that could be added to the key holder 100 without departing from the invention. All of these additional components would be provided with appropriate electronic circuitry, switches, power, communication, etc. if required.

The head 108 can contain a small camera system (photo and/or video) (not shown) oriented in the same direction as the light 118 to capture images of an attack and an attacker. It can then help identify the attacker after the fact. The camera can be activated by voice, sound, movement, touch, position or a combination of these.

The key holder 100 can contain a GPS emitting system (not shown) to track the location of the key holder 100. This can help find a lost key holder and can help locate a victim should an attack occur.

The key holder 100 could be provided with a compass.

The key holder 100 can include an emitter for emitting a signal containing information about a location of the key holder or for emitting an emergency signal. The signal can be visual using the light 118 or can be a sound if a sound emitter is provided. This emitter can be voice or sound activated if the key holder 100 contains a sound activated system (preferably with voice recognition).

The key holder 100 can include a remote controller for one or many car locking and/or ignition systems. It can also include a remote controller for a house alarm or door locking system.

They key holder 100 can be adapted to be used as a video game controller, such as for use with a Wii™ system. It could accompany a video game used for training or simulation purposes.

A training device version of the key holder 100 could be provided to allow training on how to properly use the key holder in emergency situations. It could include training keys which could be made of a flexible material and the neck, head and body could be made of a more flexible material than in the commercial version.

The key holder 100 can have an internal clock with a memory which records the use of different components of the key holder such as activation of the light, use of the whistle, etc.

The key holder 100 can have a recording system for recording sound, thereby allowing a message or a proof to be recorded and stored in an internal memory.

The key holder 100 could include any additional sensor which would be useful such as a pressure or force sensor on the head of the device to detect the strength of a blow made the user via the head of the key holder. The acquired data could be stored. It could then be communicated to another device by any communication means deemed appropriate.

The neck, head and/or the body can be provided using two or more sections which are adapted to cooperate. The sections can be permanently attached or releasable. If the sections are releasable, attachment means may be required.

The key holder 100 could be provided with a unique serial number which could be linked to a device profile and eventually to a user profile.

The key holder 100 could include an emitter for transmitting information about the key holder to an inquiring device, the information could be used together with a user profile to accumulate points and/or pay for purchases.

As will be readily understood by one skilled in the art, any additional safety system can be added to the present key holder without departing from the invention.

The embodiments described above are intended to be exemplary only. The scope of the invention is therefore intended to be limited solely by the appended claims.

I claim:

1. A key holder for personal security including:

a L-shaped body having a main elongated portion and a secondary elongated portion, the main elongated portion defining a longitudinal direction, said main elongated portion having an inner surface and an outer surface, said secondary elongated portion having an inner surface and an outer surface, the inner surface of said main elongated portion joining the inner surface of said secondary elongated portion at an inner junction so as to form an inner L-shape surface, the outer surface of said main elongated portion joining the outer surface of said secondary elongated portion at an outer junction so as to form an outer L-shape surface, said secondary elongated portion being one of equal and shorter than said main elongated portion, said secondary elongated portion being adapted to be received between two fingers of a single hand of a user, said main elongated portion being adapted to be received in a palm of said single hand;

an enlarged head at a head end of said secondary elongated portion, the enlarged head being larger than a width of the secondary elongated portion, an extremity of the enlarged head being an extremity of the key holder in the longitudinal direction, said head end being opposed to the inner junction and the outer junction;

a key attachment provided on the outer junction, said key attachment adapted to attach keys to said key holder.

2. The key holder as claimed in claim 1, further comprising a second enlarged head at a free end of the main elongated portion, the free end being opposed to the outer junction and to the inner junction.

3. The key holder as claimed in claim 1, further comprising a whistle at a whistle end of said main elongated portion, said whistle end being opposed to the outer junction and to the inner junction.

4. The key holder as claimed in claim 1, wherein said main elongated portion and said secondary elongated portion are joined at an angle of 90°±20°.

5. The key holder as claimed in claim 1, wherein said secondary elongated portion has a recessed neck portion, said recessed neck portion having a width smaller than a width of said secondary elongated portion near the outer junction and to the inner junction.

6. The key holder as claimed in claim 1, wherein one of said main elongated portion and said secondary elongated portion is at least partly hollow and adapted to receive a power unit.

7. The key holder as claimed in claim 6, further comprising at least one light provided in said enlarged head and powered by said power unit for illuminating a field of view away from a user end of the main elongated portion, the user end being opposed to the outer junction and the inner junction.

8. The key holder as claimed in claim 7, further comprising a switch on one of said main elongated portion and secondary elongated portion controlling said power unit for turning on said light.

9. The key holder as claimed in claim 1, wherein the main elongated portion has a length adapted to be one of equal and smaller than a width of a hand of the user.

10. The key holder as claimed in claim 1, wherein the secondary elongated portion has a length adapted to be one of equal and longer than a thickness of a finger of the user.

* * * * *